US006860861B2

(12) United States Patent
Polychronis

(10) Patent No.: US 6,860,861 B2
(45) Date of Patent: Mar. 1, 2005

(54) ROTATING APPARATUS FOR SURFACE MASSAGE

(76) Inventor: Gus Polychronis, 3112 - 38th Street SW, Calgary, Alberta (CA), T3E 3G3

( * ) Notice: Subject to any disclaimer, the term of this patent is extended or adjusted under 35 U.S.C. 154(b) by 256 days.

(21) Appl. No.: 10/339,052

(22) Filed: Jan. 7, 2003

(65) Prior Publication Data

US 2004/0133134 A1 Jul. 8, 2004

(51) Int. Cl.[7] ..... A61H 15/00

(52) U.S. Cl. ..... 601/113; 601/119; 601/123; 601/125; 601/127; 601/130

(58) Field of Search ..... 601/112, 113, 601/118, 119, 120, 121, 122, 123, 125, 126, 127, 128, 129, 130, 131, 134, 135, 136, 137

(56) References Cited

U.S. PATENT DOCUMENTS 1,710,051 A * 4/1929 Giacopazzi ..... 601/127
3,646,256 A 2/1972 Jacob et al.
4,127,116 A * 11/1978 Pannetier ..... 601/127
4,210,135 A 7/1980 Deuser
4,782,823 A * 11/1988 Yamasaki ..... 601/127
5,364,338 A 11/1994 Terashima
5,531,665 A 7/1996 Chen
5,554,102 A 9/1996 Chiou
5,643,181 A * 7/1997 Lin ..... 601/112
5,711,758 A 1/1998 Tseng
5,725,484 A 3/1998 Burnham
D396,296 S 7/1998 Breznik
D396,297 S 7/1998 Breznik
D404,139 S 1/1999 Young
D405,888 S 2/1999 Antoskow
6,056,709 A * 5/2000 Hashimoto ..... 601/127
6,306,109 B1 10/2001 Polychronis

* cited by examiner

*Primary Examiner*—Danton D. DeMille
*Assistant Examiner*—Quang D. Thanh

(57) ABSTRACT

A hand held mechanized massager is constructed as a cage with a series of axles arranged in a circular or near circular array. Each of the axles provides a series of side-by side massaging wheels. The wheels have a ridged circumference for rolling on the surface of the skin in a manner for stimulating the muscles and circulatory system. A driver assembly is held in a hand and is actuated for rotation of the cage and wheels.

1 Claim, 1 Drawing Sheet

ROTATING APPARATUS FOR SURFACE MASSAGE

RELATED PATENTS

U.S. Pat. No. 6,306,109 to Polychronis and issued on Oct. 23, 2001 teaches a similar device to the instant invention, but lacks mechanization.

BACKGROUND OF THE INVENTION

1. Field of the Invention

This invention relates generally to mechanized tools for massaging the surface of the body, and more particularly to such a tool providing a plurality of small wheels arrange on a cylindrical frame for massaging multiple surface areas of the body simultaneously, and includes an axially mounted, battery operated rotating feature.

2. Description of Related Art

The following art defines the present state of this field:

Breznik, U.S. Des. Pat. No. 396,296 describes an ornamental design for a massager.

Breznik, U.S. Des. Pat. No. 396,297 describes an ornamental design for a massager.

Young, U.S. Des. Pat. No. 404,139 describes an ornamental design for a stimulating massager.

Antoskow, U.S. Des. Pat. No. 405,888 describes an ornamental design for a massager.

Morrison, U.S. Pat. No. 3,645,256 describes a massage-exerciser device consisting of a number of resilient discs of frustoconical shape assembled in stacked coaxial relation to form a roller having peripheral ribs and grooves, said discs being reversible whereby to vary the pattern of said ribs and grooves, hard and soft spacers adapted to be inserted selectively between said discs whereby to increase or decrease the effective hardness of the roller, and a clamp for applying a variable axial compressive load to said roller, also to vary the effective hardness thereof, and a frame for carrying a plurality of said rollers rotatably in parallel, spaced-apart relation.

Deuser, U.S. Pat. No. 4,210,135 describes a plurality of non-rotating disc-shaped massaging members, which are fixed, on a flexible shaft held at its ends by a bow. Spherical rolling members between the massaging members space the massaging members apart and limit their depth of depression into the skin.

Terashima, U.S. Pat. No. 5,364,338 describes a portable massager which allows self-massaging to be performed in virtually any position. The massager includes at least one pair of pressers mounted at a fixed separation interval onto a rod, which can be separated into two sections, if desired. The pressers may be freely rotatable or non-rotably fixed in position on the rod. The surfaces of the pressers are formed into irregular shapes having indentations and projections. Handles having grips on their ends are either fixed or mounted so as to rotate freely on the rod and project outwardly away from the pressers and toward a respective end of the rod.

Chen, U.S. Pat. No. 5,531,665 describes a massaging device which includes a cord, a plurality of massaging balls and a plurality of biasing units strung alternately on the cord, and a connecting unit for joining two ends of the cord together. The biasing units ensure that the massaging balls remain evenly distributed on the cord.

Chiou, U.S. Pat. No. 5,554,102 describes a portable massaging device which comprises of a cylindrical body in which a power unit is housed and over which a mass aging set is fitted. The power unit is composed of a motor, a battery set, a cam and a conducting member. The massaging set is composed of a plurality of fitting members and massaging nipples. The fitting members are provided respectively with a plurality of receiving recesses in which the massaging nipples are held. The fitting members are further provided respectively in the connection ends thereof with a plurality of mortises and tenons, by way of which the fitting members are held together. An end cap is fastened to one end of the cylindrical body for locating the massaging set and for shielding the power unit. A handle is fastened at one end thereof with the end cap and at another end thereof with the conducting member Tseng, U.S. Pat. No. 5,711,758 describes a handy body massager including a casing defining a substantially U-shaped handle, a barrel supported on rollers in two roller holders between two opposite ends of the handle and having massaging rollers supported on roller racks around the periphery and a fixed connecting block on the inside, a motor fixedly mounted in a motor chamber at one end of the handle, a reducing gear coupled to the motor shaft of the motor and having an output shaft fixedly connected to a connecting block of the barrel and adapted for turning the barrel upon the operation of the motor, a massaging disk coupled to the output shaft of the reduction gear outside the casing and having a plurality of massaging rollers turned about a respective wheel axle at an outer side for massaging.

Burnham, U.S. Pat. No. 5,725,484 describes a manual personal massager comprising of handles to be gripped by the hand of a person. A web network grid is provided. A facility is for attaching opposite ends of the web network grid to the pair of handles. A plurality of massaging members are carried in the web network grid to be applied to a body part of a person and moved back and forth by the movement of the pair of handles.

Polychronis, U.S. Pat. No. 6,306,109, teaches a hand held manual massager constructed as a cylindrical cage with a series of axles arranged in a circular or near circular array. Each of the axles provides a series of side-by-side massaging wheels. The wheels have a ridged circumference for rolling on the surface of the skin in a manner for stimulating the muscles and circulatory system.

The Polychronis patent teaches a manually operated surface massage device that must be pressed against the skin by hand. Such a device suffers from lacking a means for fluidly rolling the device, especially at higher speeds since it is held by its rim in the palm of a hand. There is clearly needed a device such as the prior Polychronis machine but that is able to overcome the problems of rolling and pressing at the same time that the '109 patent fails to teach. The present invention fulfills these needs and provides further related advantages as described in the following summary.

SUMMARY OF THE INVENTION

The present invention teaches certain benefits in construction and use which give rise to the objectives described below.

The present invention provides a hand held mechanized massager constructed as a cylindrical cage with a series of axles arranged in a circular or near circular array. Each of the axles provides a series of side-by-side massaging wheels. The wheels have a ridged or smooth circumference for rolling on the surface of the skin in a manner for stimulating the muscles and circulatory system. The device is approximately the width of a hand and of such size as to be grasped by a hand for manipulation on the body for massage. A battery operated handle is axially mounted and provides continuous rotation.

A primary objective of the present invention is to provide a manual surface massage device having advantages not taught by the prior art.

Another objective is to provide such a massaging device enabled for surface auto-massage.

A further objective is to provide such a massaging device capable of being rolled on separate small wheels or being rotated.

A still further objective is to provide such a massaging device capable of being held in one hand and automatically rotated.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
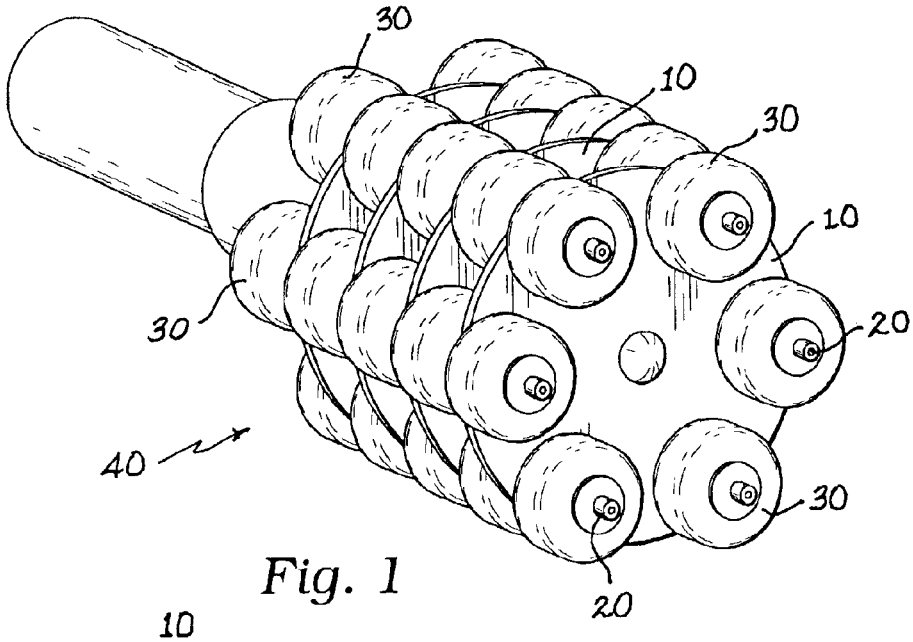
FIG. 1 is a distal perspective view of a preferred embodiment of the present invention.
Figure 2:
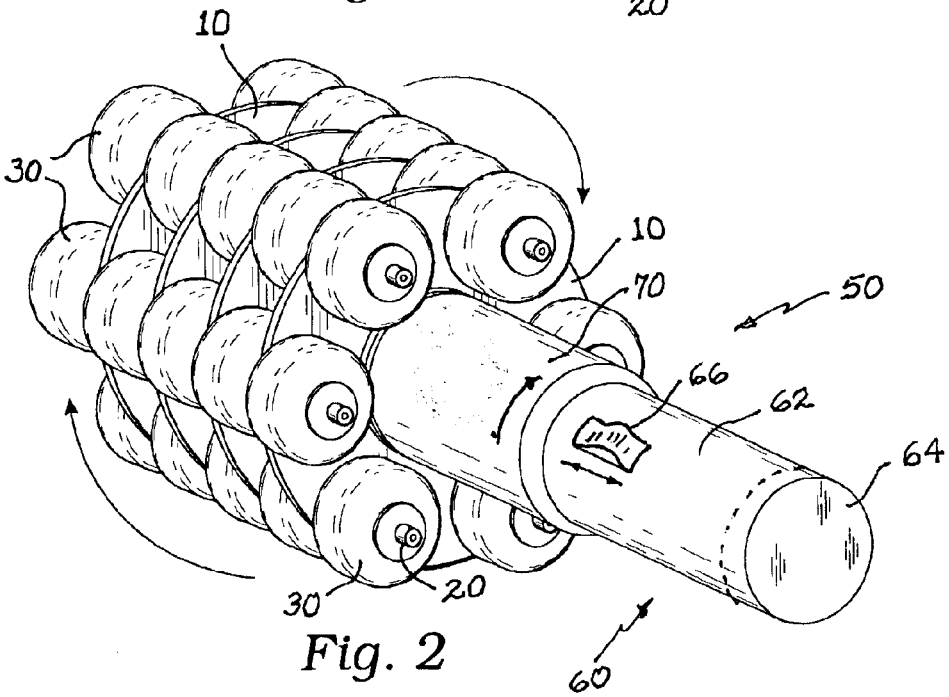
FIG. 2 is a proximal perspective view thereof showing directions of motion.

The above described drawing figures illustrate the invention, a mechanized massaging apparatus comprising four essential structural elements. The first of these elements is a plurality of spaced apart frame members, each preferably being a disk 10 or as a circular or oblate (oval) ring as shown in FIGS. 1 and 2. Each of the frame members provides a plurality of axle receiving means such as holes arranged in parallel and in a closed figure such as a circle. The frame members or disks 10 are preferably made of metal or plastic and are rigid elements in the preferred embodiment, but may inventively have some flexibility or resilience.

The second structural element is a plurality of linear axle shafts, i.e., axles 20 all of which preferably have a common diameter and length. All of the axle shafts 20 are positioned in parallel and in circular alignment and are frictionally received by the disks 10 so as to enable the axles 20 and the disks 10 to form a rigid cage structure for fixed frame 40.

The third structural element of the present invention is a plurality of identical disk shaped wheels 30, each of the which provide a peripheral, generally circular and smooth or irregular surface, as is clearly shown in the figures. Each of the wheels 30 provide a central axial hole for receiving one of the linear axle shafts 20 such that each of the wheels 30 is able to freely rotate on the axle shaft 20 it is mounted on, i.e., the central axial hole is large enough for the wheel to freely rotate on its axle shaft 20.

The linear axle shafts 20 are engaged with the disks 10 and the disk shaped wheels 30 to form the fixed frame 40 assembly as is shown in the figures. Each of the wheels 30 on each of the linear axle shafts 20 is separated from each adjacent one of the wheels 30 by one of the disks 10 which therefore establishes a preferred common lateral wheel spacing in the apparatus. This is advantageous during massage since it allows the flesh to move laterally when pressed by a given wheel 30 and this action, as is well known, is highly therapeutic.

The fourth structural element of the present invention is a motorized driver assembly 50 including a stationary handle 60 and, in axial alignment therewith, a revolving portion 70 engaged axially with the disks 10. A driver circuit, including an electric motor 62, power source 64 and switch 66 arranged, as is notoriously well known in the art, for rotating the revolving portion 70 and therefore the fixed frame 40, as is shown in FIG. 2, such that with the stationary handle 60 held in one hand of a user, the revolving portion 70 is driven in rotation for rotating the disks 10, axles 20 and wheels 30.

In use the instant invention is advantageously applied to the surface of the body to produce certain benefits such as relaxing of muscles, improved blood flow, skin toning and other well known benefits which are well defined in the massage practice and literature.

The present invention may be used by simply pressing it into the skin's surface without any motion whatsoever, or by holding the frame 40 so that it cannot rotate and moving it across the skin's surface in a forward and backward oscillating motion, or, finally, as is the preferred embodiment, by driving the frame 40 with the handle 60 so as to rotate about its own axis, thereby bringing rows of the wheels 30 into contact with the shin's surface in a continuous sequential manner.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A mechanized massaging apparatus comprising: a plurality of circular, spaced apart disks, the disks supporting plural axles arranged in circular parallel alignment, each of the axles rotationally engaging a plurality of wheels, the wheels separated by the disks, with each of the disks sandwiched between plural pairs of the wheels; and a motorized driver assembly including a stationary handle and, in axial alignment therewith, a revolving portion engaged axially with the disks; and a driver circuit including an electric motor, power source and switch arranged for rotating the revolving portion and the disks, such that with the stationary handle held in a hand, the revolving portion is driven in rotation for rotating the disks, axles and wheels.

* * * * *